US011756704B2

(12) United States Patent
Chen

(10) Patent No.: US 11,756,704 B2
(45) Date of Patent: Sep. 12, 2023

(54) DATA TRANSMISSION CABLE

(71) Applicant: ALLTOP ELECTRONICS (SUZHOU) LTD., Suzhou (CN)

(72) Inventor: Yichang Chen, New Taipei (TW)

(73) Assignee: ALLTOP ELECTRONICS (SUZHOU) LTD., Suzhou (CN)

( * ) Notice: Subject to any disclaimer, the term of this patent is extended or adjusted under 35 U.S.C. 154(b) by 0 days.

(21) Appl. No.: 17/720,219

(22) Filed: Apr. 13, 2022

(65) Prior Publication Data

US 2022/0344074 A1 Oct. 27, 2022

(30) Foreign Application Priority Data

Apr. 21, 2021 (TW) ..... 110204386

(51) Int. Cl.
*H01B 7/08* (2006.01)
*H01B 11/00* (2006.01)

(52) U.S. Cl.
CPC ..... *H01B 7/0861* (2013.01); *H01B 7/0853* (2013.01); *H01B 11/002* (2013.01)

(58) Field of Classification Search
CPC . H01B 7/02; H01B 7/002; H01B 7/08; H01B 7/0838; H01B 7/0861; H01B 11/02; H01B 11/20; H01B 11/06
USPC ..... 174/110 R, 113 R, 117 R, 117 F, 117 FF, 174/36
See application file for complete search history.

(56) References Cited

U.S. PATENT DOCUMENTS 3,391,246 A * 7/1968 Freeman ..... H05K 3/20 174/117 FF
3,612,744 A * 10/1971 Thomas ..... H01B 7/0838 174/117 FF
3,757,029 A * 9/1973 Marshall ..... H01B 7/08 174/117 FF
4,287,385 A * 9/1981 Dombrowsky ..... H01B 7/0838 174/105 R
4,382,236 A * 5/1983 Suzuki ..... H01B 7/0838 428/209
RE31,477 E * 12/1983 Marshall ..... H01B 7/0838 174/117 FF
4,475,006 A * 10/1984 Olyphant, Jr. ..... H01B 7/0861 174/105 R
4,639,693 A * 1/1987 Suzuki ..... H05K 1/024 174/117 FF
5,900,588 A * 5/1999 Springer ..... H01B 7/0861 174/117 F
7,399,929 B2 * 7/2008 Ueno ..... H01B 7/0861 174/117 FF
7,429,702 B2 * 9/2008 Kobayashi ..... H05K 1/0219 174/117 FF (Continued)

*Primary Examiner* — William H. Mayo, III
(74) *Attorney, Agent, or Firm* — Cheng-Ju Chiang

(57) ABSTRACT

A data transmission cable includes a plurality of juxtaposed wires, a plastic layer enclosing on the wires integrally and a metallic shielding layer arranged on an outer side of the plastic layer. The metallic shielding layer defines a first shielding layer and a second shielding layer separated from each other and opposite to each other, the first shielding layer and the second shielding layer cover opposite sides of the plastic layer in a direction perpendicular to an arrangement direction of the wires, and both lateral edges of the first shielding layer and the second shielding layer in a width direction do not extend beyond the plastic layer.

13 Claims, 4 Drawing Sheets

(56) References Cited

U.S. PATENT DOCUMENTS

| | | | | |
|---|---|---|---|---|
| 7,807,927 | B2 * | 10/2010 | Yeh | H01B 7/0838<br>174/117 FF |
| 7,868,254 | B2 * | 1/2011 | Matsushita | H01B 7/0861<br>174/117 FF |
| 8,338,709 | B2 * | 12/2012 | Kodama | H01B 7/0838<br>174/117 FF |
| 2010/0130054 | A1 * | 5/2010 | Le | H01B 7/0838<br>439/502 |

* cited by examiner

DATA TRANSMISSION CABLE

CROSS REFERENCE TO RELATED APPLICATIONS

The present application claims the priority of Taiwan Patent Application No. 110204386 filed on Apr. 21, 2021, the content of which is hereby incorporated by reference into this application.

BACKGROUND

1. Technical Field

The present disclosure relates to a data transmission cable, and more particularly to a data transmission cable with stable signal transmission performance.

2. Description of Related Art

In the 3C industry, a transmission cable can be used as a medium for an electrical connection between two electronic devices and can carry out the expected signal transmission stably. Therefore, the transmission cable is widely used in various electronic devices. In particular, transmission cables connected with USB, HDMI, DVI, Displayport and other types of connector has a performance of higher transmission rate, longer transmission distance and higher quality, and is popular with consumers. The transmission cable usually has a plurality of metal wires inside thereof, the metal wires are generally fixed only by an outer mylar layer in a cylindrical shape, and with no shielding settings, thereby the signal transmission stability of the entire data transmission cable is poor.

It is desirable to provide an improved data transmission cable for solving above problems.

SUMMARY

In one aspect, the present invention includes a data transmission cable comprising a plurality of juxtaposed wires, a plastic layer enclosing on the wires integrally and a metallic shielding layer arranged on an outer side of the plastic layer. The metallic shielding layer defines a first shielding layer and a second shielding layer separated from each other and opposite to each other, the first shielding layer and the second shielding layer cover opposite sides of the plastic layer in a direction perpendicular to an arrangement direction of the wires, and both lateral edges of the first shielding layer and the second shielding layer in a width direction do not extend beyond the plastic layer.

The invention has the advantages that: The data transmission cable in present invention is provided with the plastic layer integrally enclosing a plurality of wires side by side to position the wires at relative positions, the metallic shielding layer is disposed on opposite sides of the plastic layer so as to shield the external interference and ensure the signal transmission stability of the wires. Moreover, both sides of the metallic shielding layer are not extended beyond the plastic layer, which not only makes the operation of covering the metallic shielding layer more convenient, but also suitable for quantitative production and improve production efficiency.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
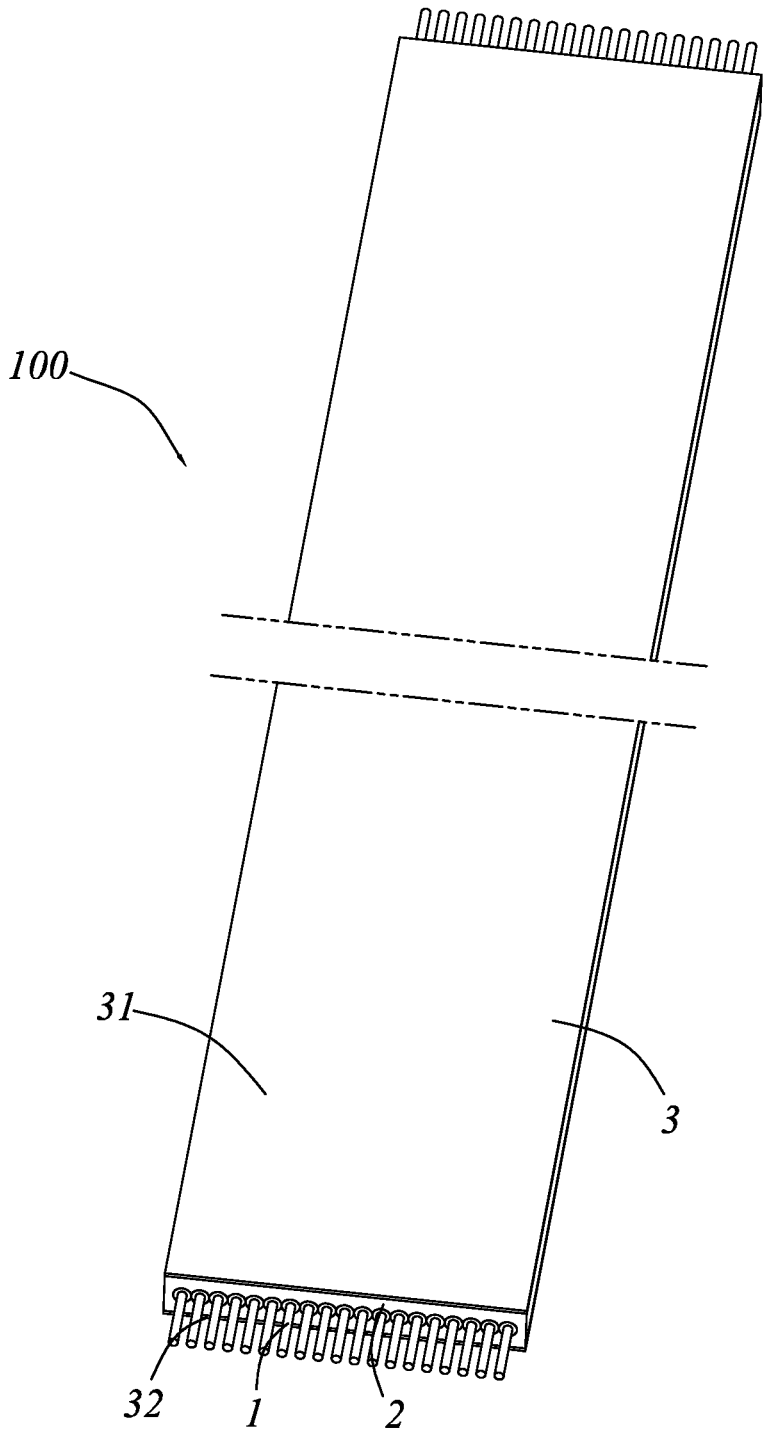
FIG. 1 is a perspective view of a data transmission cable in accordance with a preferred embodiment of the present disclosure.

Reference will now be made to the drawing figures to describe the embodiments of the present disclosure in detail. In the following description, the same drawing reference numerals are used for the same elements in different drawings.

Referring to FIGS. 1 to 5, the present disclosure relates to a flat data transmission cable 100, and the data transmission cable 100 comprises a plurality of juxtaposed wires 1, a plastic layer 2 enclosing on the wires 1 integrally and a metallic shielding layer 3 arranged on an outer side of the plastic layer 2. The metallic shielding layer 3 defines a first shielding layer 31 and a second shielding layer 32 separated from each other and opposite to each other, the first shielding layer 31 and the second shielding layer 32 cover opposite sides of the plastic layer 2 in a direction perpendicular to an arrangement direction of the wires 1, and both lateral edges of the first shielding layer 31 and the second shielding layer 32 in a width direction do not extend beyond the plastic layer 2.

In detail, in the present embodiment, each wire 1 has a conductor 11 and an insulative cladding layer 12 enclosing on the conductor 11.

Preferably, each conductor 11 has an outer diameter (traditionally expressed in AWG size) in the range of 30 to 34 American Wire Gauge (AWG), thus a thickness of the data transmission cable 100 of the present invention can be made thinner and the signal transmission rate is not affected. Each conductor 11 extends along a length of the data transmission cable 100 and co-extends with the cladding layer 12, the plastic layer 2 and metallic shielding layer 3 along the length of the data transmission cable 100.

The cladding layer 12 have a same radial thickness in a circumferential direction of the wire 1, and is preferably made of plastic material with a dielectric coefficient close to that of air, such as a polyhydrocarbon compound, and further, the polyhydrocarbon compound is preferably polyethylene. The dielectric constant of the cladding layer 12 is controlled within 2.5, therefore the impedance of the cladding layer 12 can be reduced, and a better signal transmission environment can be provided for the conductors 11, the propagation delay of signals and crosstalk between signals can be reduced to ensure high-speed and effective transmission of signals and reduce signal attenuation.

In addition, by providing the cladding layer 12, before or during cladding the plastic layer 2 of the data transmission cable 100, the conductor 11 of each wire 1 can be insulated from the outside world by the cladding layer 12, thereby facilitating the arrangement of wires 1 without fear of short-circuiting due to contact between adjacent conductors 11.

Figure 2:
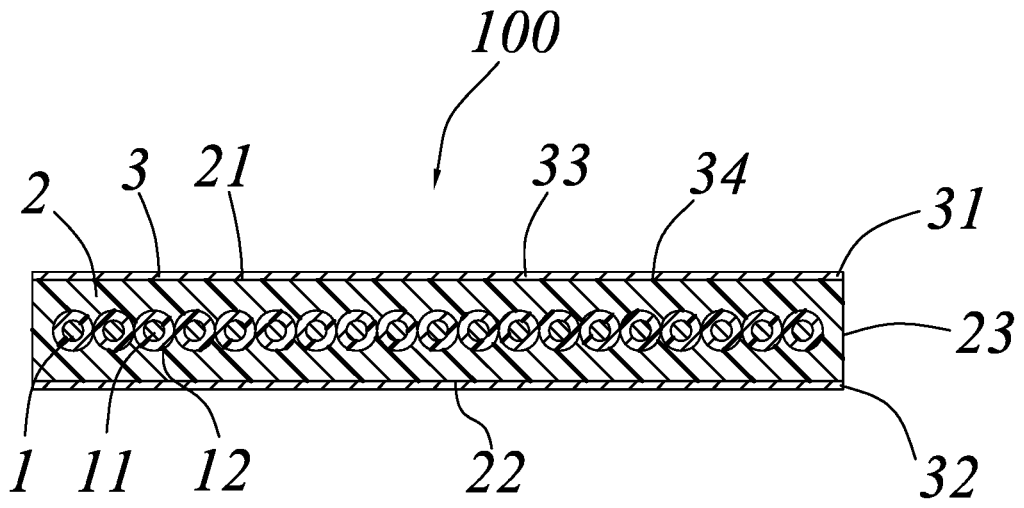
FIG. 2 is a top view of the data transmission cable shown in FIG. 1.

Combined with FIGS. 1 and 2, the wires 1 are arranged at equal intervals in this embodiment, and in the arrangement direction of the wires 1, the number of the wires 1 is between 4 and 50. Preferably, when the cladding layer 12 is provided, the data transmission cable 100 is provided so that a center distance between two neighboring wires 1 is equal to an outer diameter of the wire 1, that is to say, every two neighboring wires 1 are disposed in close proximity to each other, thereby controlling of overall forming of the data transmission cable 100 conveniently.

The signal transmission settings of the wires 1 can be configured according to requirements, e.g., can comprise at least two grounding wires and at least a signal wire between the two grounding wires. When the wires 1 comprise a differential signal wire, at least one grounding wire is disposed on each side of the differential signal wire to improve the efficiency and stability of high frequency signal transmission.

In present invention, the number of the wires 1 is set to 3N+1, N is a natural number and in the arrangement direction of the wires 1, the wires 1 located on both sides are grounding wires, and N is not zero. The signal wires of the wires 1 are defined in pairs by differential signal wires to form differential signal wire pairs, when the number of the wires 1 is odd, in the arrangement direction of the wires 1, the wire 1 arranged at the middle position is a grounding wire, when the number of the wires 1 is even, in the arrangement direction of wires 1, the wires 1 arranged at the middle position are a pair of differential signal wires. In the above arrangement, the distance between the centers of two adjacent differential signal wire pairs in this embodiment is 0.85 mm to 2 mm, and preferably defined in 1.2 mm to 1.65 mm.

In further, the conductor 11 of each wire 1 has an outer diameter (traditionally expressed in AWG size) in the range of 30 to 34 American Wire Gauge (AWG), the ratio of the thickness of the cladding layer 12 to the diameter of the conductor 11 is defined in the range of 0.4 to 0.8, in combination with the equally spaced arrangement of the wires 1 and the material setting of the cladding layer 12 in this embodiment, the differential impedance between the differential signal wires in each pair can be controlled in the range of 85 Ohm to 100 Ohm, and each differential signal wire pair has an insertion loss of less than 12.5 dB/m in any frequency band from 0 to 16 GHz.

For example, while the outer diameter of the conductor 11 is 30 AWG, the outer diameter of the conductor 11 is 0.255 mm, and when the thickness of the cladding layer 12 is defined in the range of 0.115 mm to 0.135 mm, the differential impedance between the differential signal wires in each pair is approximately 85 Ohm, when the thickness of the cladding layer 12 is defined in the range of 0.135 mm to 0.155 mm, the differential impedance between the differential signal wires in each pair is approximately 100 Ohm.

While the outer diameter of the conductor 11 is 32 AWG, the outer diameter of the conductor 11 is 0.202 mm, and when the thickness of the cladding layer 12 is defined in the range of 0.085 mm to 0.115 mm, the differential impedance between the differential signal wires in each pair is approximately 85 Ohm, when the thickness of the cladding layer 12 is defined in the range of 0.115 mm to 0.135 mm, the differential impedance between the differential signal wires in each pair is approximately 100 Ohm.

The plastic layer 2 is enclosing on the cladding layers 12 of the wires 1 to form a common single insulation layer. Preferably, the plastic layer 2 defines a top surface 21 and a bottom surface 22 parallel to the arrangement direction of wires 1, and two lateral surfaces 23 connecting two sides of the top surface 21 and the bottom surface 22. In this embodiment, the aforementioned two lateral surfaces 23 are perpendicular to the top surface 21 and the bottom surface 22, of course, after the metallic shielding layer 3 is laminated by hot pressing, the two lateral surfaces 23 can also be non-vertical to the top surface 21 and the bottom surface 22.

In other embodiments of present invention, the two lateral surfaces 23 can also be defined directly non-perpendicular to the top surface 21 and bottom surface 22, mainly able to enclose the wires 1 at both edges, so that all wires 1 are held together by the plastic layer 2.

Preferably, the distance between the outermost end of each lateral surface 23 and the wire 1 at the edge is not greater than 0.25 mm.

When the top surface 21 and the bottom surface 22 of the plastic layer 2 are parallel to each other, the arrangement of the wires 1 can be effectively maintained to prevent twisting or folding phenomenon; further, it can also facilitate the lamination setting of the metallic shielding layer 3 to avoid air entrapment between the plastic layer 2 and metallic shielding layer 3.

The plastic layer 2 is made of same or similar material as the cladding layer 12, and preferably made of same kind material, thus when the data transmission cable 100 in the present invention is molded, the combination of the plastic layer 2 and the cladding layer 12 is better, and a good fusion can be achieved with minimizing the stratification problem or air entry, thus the forming effect is better. Further, the same kind material is a polyhydrocarbon compound, and further, the polyhydrocarbon compound is preferably polyethylene.

In addition, the plastic layer 2 and the cladding layer 12 can be preferably made of plastic material with a dielectric coefficient close to air, therefore the impedance of the cladding layer 12 and the plastic layer 2 can be reduced, and a better signal transmission environment can be provided for the conductors 11, the propagation delay of signals and crosstalk between signals can be reduced to ensure high-speed and effective transmission of signals and reduce signal attenuation.

Figure 3:
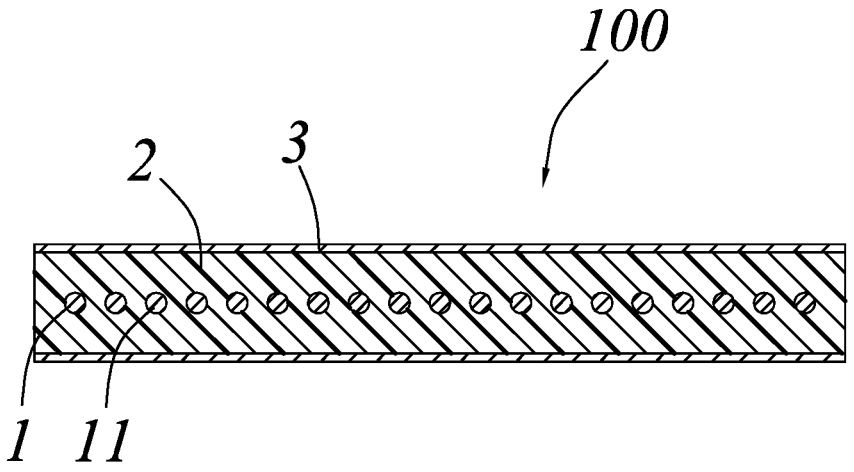
FIG. 3 is a front view of a data transmission cable in accordance with another preferred embodiment of the present disclosure.
Figure 4:
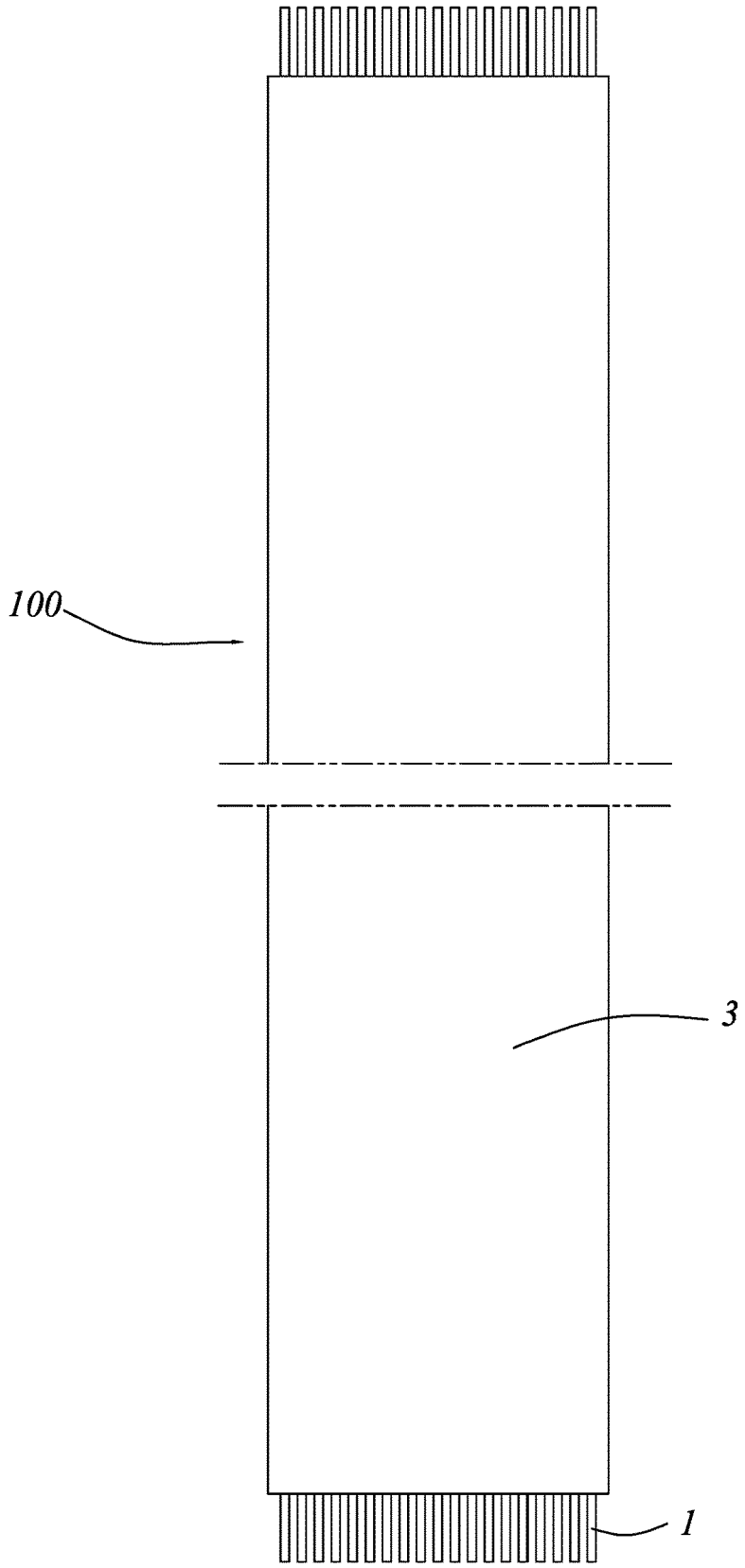
FIG. 4 is a front view of the data transmission cable shown in FIG. 1.
Figure 5:
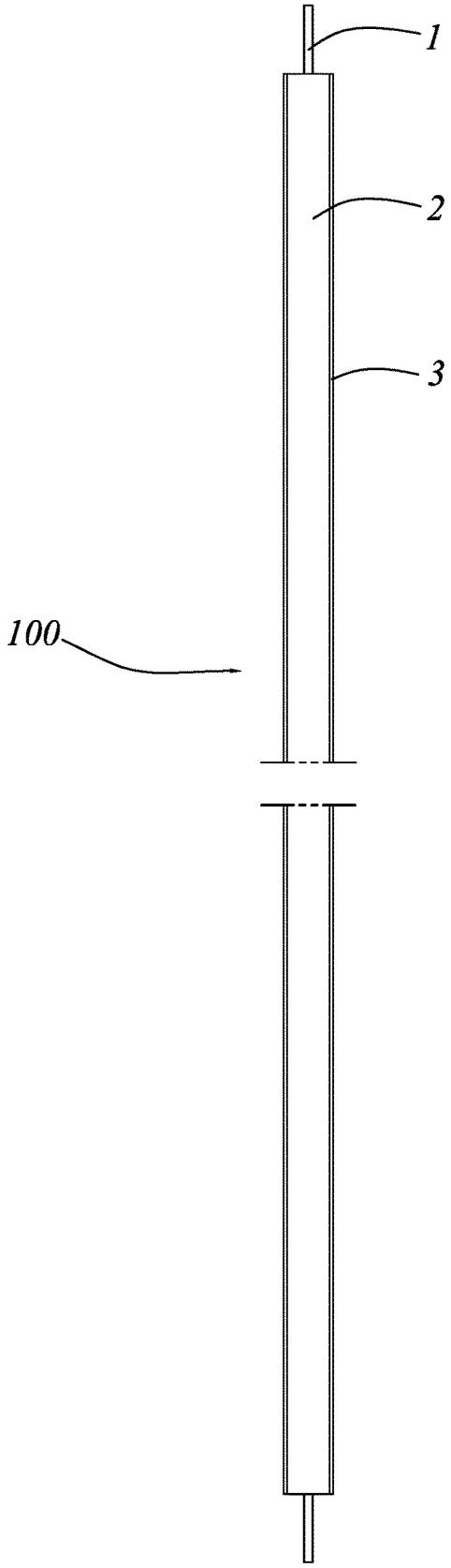
FIG. 5 is a side view of the data transmission cable shown in FIG. 1.

Another embodiment of the present disclosure is disclosed in FIG. 3, each wire 1 also can have only the conductor 11 without the cladding layer 12, that is, the plastic layer 2 is directly enclosing on the wires 1, and the same effect can be achieved. By adopting the setting, the thickness of the plastic layer 2 can be further reduced, and the overall thickness of the data transmission cable 100 can be further reduced.

In the present invention, after the plastic layer 2 is enclosing around the wires 1, the overall thickness of the data transmission cable 100 is around 0.3 mm to 1.2 mm. The thickness of the plastic layer 2 can be defined as thin as possible, as long as the relative position of all wires 1 is guaranteed to be fixed.

In further, when the wires 1 comprise signal wires, the projections of the first shielding layer 31 and the second shielding layer 32 of the metallic shielding layer 3 in a direction perpendicular to the arrangement direction of the wires 1 both at least cover the signal wires, and then signal transmission environment of the signal wires can be protected, to ensure its transmission efficiency and stability.

Preferably, transverse extension widths of the first shielding layer 31 and the second shielding layer 32 are defined same as a transverse extension width of the plastic layer 2, that is to say, both side edges of the first shielding layer 31 and the second shielding layer 32 are aligning with the corresponding lateral surfaces 23 of the plastic layer 2, this not only provides effective shielding and protection for an upper side and a lower side of all the wires 1, but also facilitates controlling of the lamination of the metallic shielding layer 3, and it is possible to produce a plurality of data transmission cables 100 simultaneously and to split them at a later stage, i.e. to achieve quantitative production. In further, the two wires located at both sides of the plurality of wires 1 are grounding wires, that is, the metallic shielding layer 3 can protect the data transmission cable 100 from an upper side and a lower side thereof, and further the data transmission cable 100 can be fully and completely protected.

In further, the metallic shielding layer 3 has at least an aluminum foil layer 33 and a bonding layer 34 arranged on the side of the aluminum foil layer 32 facing to the plastic layer 2, thus the metallic shielding layer 3 is bonding to the outer side of the plastic layer 2 by the bonding layer 34. Thereby the fixing of the metallic shielding layer 3 is simpler and convenient, and without an intervention of a mylar layer fixing, the whole data transmission cable can be made thinner and more flexible, moreover, air can be discharged during bonding. The bonding layer 34 can be made of hot melt adhesive, bonding strength and tightness between the metallic shielding layer 3 and the plastic layer 2 can be increased by means of heat sealing and bonding, and achieve integrally bonding without air entrapment. The effect of compaction can be achieved without the discharged air entering, thereby to achieve a tight wrapping, better high frequency transmission performance, soft and light effect.

In addition, the metallic shielding layer 3 further has an insulating layer arranged on the side of the aluminum foil layer 33 deviating from the plastic layer 2, the insulating layer can replace the mylar layer in the prior art, insulate the outside and protect the aluminum foil layer 33 at the same time. Of course, the data transmission cable 100 in present invention can be further provided with a mylar layer outside the metallic shielding layer 3.

Furthermore, combined with the above two embodiments with or without the insulating layer, the whole thickness dl of the metallic shielding layer 3 is defined in the range of 0.010 mm to 0.055 mm, to minimize the thickness of the data transmission cable 100 on the basis of realizing external shielding. Preferably, the whole thickness of the metallic shielding layer 3 is defined in the range of 0.015 mm to 0.025 mm. Further, the overall thickness of the data transmission cable 100 in the present invention can be controlled about 0.4 mm to 1.3 mm.

For example, while the outer diameter of the conductor 11 is 32 AWG, the outer diameter of the conductor 11 is 0.202 mm, the center distance between two neighboring wires 1 is defined in the range of 0.35 mm to 0.5 mm, and preferably 0.4 mm to 0.45 mm; the thickness of the data transmission cable 100 can be controlled about 0.45 mm to 1.1 mm, and preferably in the range of 0.5 mm to 0.8 mm.

While the outer diameter of the conductor 11 is 30 AWG, the outer diameter of the conductor 11 is 0.255 mm, the center distance between two neighboring wires 1 is defined in the range of 0.45 mm to 0.6 mm, and preferably 0.5 mm to 0.55 mm; the thickness of the data transmission cable 100 can be controlled about 0.55 mm to 1.2 mm, and preferably in the range of 0.6 mm to 0.8 mm.

In conclusion, the data transmission cable 100 in present invention is provided with the plastic layer 2 integrally enclosing a plurality of wires 1 side by side to position the wires 1 at relative positions, the metallic shielding layer 3 is disposed on opposite sides of the plastic layer 2 so as to shield the external interference and ensure the signal transmission stability of the wires 1. Moreover, both sides of the metallic shielding layer 3 are not extended beyond the plastic layer 2, which not only makes the operation of covering the metallic shielding layer 3 more convenient, but also suitable for quantitative production and improve production efficiency.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

In addition, in the present invention, the relevant values can be allowed to exist with a certain tolerance, which can be plus or minus 0.02 mm or so.

So far, a person skilled in the art shall know that although a plurality of exemplary embodiments of the present invention have been described above in detail, various variations and improvements can be directly determined or deducted from the content disclosed by the present invention without departing from the spirit and scope of the present invention. Therefore, all those variations and improvements shall be deemed to be covered by the scope of the present invention.

What is claimed is:

1. A data transmission cable, comprising:

a plurality of juxtaposed wires;

a plastic layer enclosing on the wires integrally; and a metallic shielding layer arranged on an outer side of the plastic layer;

wherein the metallic shielding layer defines a first shielding layer and a second shielding layer separated from each other and opposite to each other, the first shielding layer and the second shielding layer cover opposite sides of the plastic layer in a direction perpendicular to an arrangement direction of the wires, and both lateral edges of the first shielding layer and the second shielding layer in a width direction do not extend beyond the plastic layer;

wherein in the arrangement direction of the wires, the distance between the outermost end of each lateral surface of the plastic layer and the neighboring wire is not greater than 0.25 mm.

2. The data transmission cable as claimed in claim 1, wherein the wires comprise at least two grounding wires and a signal wire, the projections of the first shielding layer and the second shielding layer in a direction perpendicular to the arrangement direction of the wires both at least cover the signal wire.

3. The data transmission cable as claimed in claim 2, wherein the number of the wires 1 is set to 3N+1, N is a natural number and in the arrangement direction of the wires, the wires 1 located on both sides are grounding wires, and N is not zero.

4. The data transmission cable as claimed in claim 3, wherein the signal wires of the wires are defined in pairs by differential signal wires to form differential signal wire pairs, when the number of the wires is odd, in the arrangement direction of the wires, the wire arranged at the middle position is a grounding wire.

5. The data transmission cable as claimed in claim 3, wherein the signal wires of the wires are defined in pairs by differential signal wires to form differential signal wire pairs, when the number of the wires is even, in the arrangement direction of wires, the wires arranged at the middle position are a pair of differential signal wires.

6. The data transmission cable as claimed in claim 3, wherein the wires comprise at least two pairs of differential signal wires, and the distance between the centers of two adjacent differential signal wire pairs in this embodiment is 0.85 mm to 2 mm.

7. The data transmission cable as claimed in claim 1, wherein the plastic layer defines a top surface and a bottom surface parallel to the arrangement direction of wires, the first shielding layer covers the top surface and the second shielding layer covers the bottom surface, lateral edges of the first shielding layer are aligning with corresponding edges of the second shielding layer along a thickness direction of the data transmission cable.

8. The data transmission cable as claimed in claim 1, wherein conductors of the wires have a same outer diameter, and in a width direction of the data transmission cable, every two neighboring wires have a same center distance; in a thickness direction of the data transmission cable, the deviation between the axis of two adjacent wires is not greater than the outer diameter of one conductor.

9. The data transmission cable as claimed in claim 8, wherein the conductor of each wire has the outer diameter in the range of 30 to 34 AWG, the overall thickness of the data transmission cable is controlled about 0.4 mm to 1.3 mm.

10. The data transmission cable as claimed in claim 9, wherein the outer diameter of the conductor is 30 AWG, the thickness of the data transmission cable is 0.55 mm to 1.2 mm, the center distance between two neighboring wires is in the range of 0.45 mm to 0.6 mm.

11. The data transmission cable as claimed in claim 9, wherein the outer diameter of the conductor is 32 AWG, the thickness of the data transmission cable is 0.45 mm to 1.1 mm, the center distance between two neighboring wires is in the range of 0.35 mm to 0.5 mm.

12. The data transmission cable as claimed in claim 8, wherein each wire further has a cladding layer enclosing on the conductor, the ratio of the thickness of the cladding layer to the diameter of the conductor is defined in the range of 0.4 to 0.8.

13. The data transmission cable as claimed in claim 1, wherein the metallic shielding layer has at least an aluminum foil layer and a bonding layer arranged on the side of the aluminum foil layer facing to the plastic layer, the metallic shielding layer is bonding to an outer side of the plastic layer by the bonding layer.

* * * * *